US006409204B1

(12) United States Patent
Ayliffe

(10) Patent No.: US 6,409,204 B1
(45) Date of Patent: Jun. 25, 2002

(54) TELEMARK SKI BOOT AND RELEASABLE BINDING ASSEMBLY

(75) Inventor: Harold Edward Ayliffe, 1560 Richmond Street, North Vancouver, British Columbia (CA), V7J 1B2

(73) Assignee: Harold Edward Ayliffe, North Vancouver (CA)

( * ) Notice: Subject to any disclaimer, the term of this patent is extended or adjusted under 35 U.S.C. 154(b) by 0 days.

(21) Appl. No.: 09/573,570

(22) Filed: May 19, 2000

Related U.S. Application Data

(63) Continuation-in-part of application No. 09/014,331, filed on Jan. 27, 1998, now abandoned.

(51) Int. Cl.[7] ..... A63C 9/00

(52) U.S. Cl. ..... 280/613; 36/117.2; 36/117.3; 280/615

(58) Field of Search ..... 36/117.1, 117.2, 36/117.3, 115; 280/613, 614, 615, 611

(56) References Cited

U.S. PATENT DOCUMENTS 3,675,938 A 7/1972 Sigl
3,930,660 A 1/1976 Fréchin
4,273,355 A 6/1981 Storandt
4,836,572 A 6/1989 Pozzobon
4,920,665 A 5/1990 Pack et al.
5,499,838 A 3/1996 Hauglin et al.
5,518,264 A 5/1996 Broughton
5,697,631 A 12/1997 Ratzek et al.
5,897,127 A 4/1999 Hauglin

*Primary Examiner*—Michael Mar
(74) *Attorney, Agent, or Firm*—Michael A. Glenn

(57) ABSTRACT

A boot and binding assembly is arranged for use with a ski. The boot has a toe portion, a flexible sole and a heel portion. A rigid interconnect member is mounted to the toe portion underneath the sole of the boot. The binding includes a toe piece, a latch assembly, raised portions and a release mechanism. During use, the toe portion mates with the toe piece on the ski while one end of the interconnect member releasably mates with a latch assembly on the ski. When the interconnect member is secured to the ski by the latch, a skier can lift the heel portion away from the ski by flexing the sole. This enables a skier to execute cross-country and telemark style skiing manoeuvres. The latch assembly may include a pivoting member which holds the rearward end of the interconnect member. The toe portion preferably has lateral edges for facilitating securement beneath the toe piece. Preferably, a cord and handle assembly is provided as the release mechanism to facilitate disengagement of the boot from the binding.

14 Claims, 7 Drawing Sheets

TELEMARK SKI BOOT AND RELEASABLE BINDING ASSEMBLY

CROSS REFERENCE TO RELATED APPLICATIONS

This is a continuation-in-part of application Ser. No. 09/014,331 filed Jan. 27, 1998 now abandoned and entitled RELEASABLE TELEMARK SKI BOOT AND BINDING ASSEMBLY.

FIELD OF THE INVENTION

This invention relates generally to ski bindings. More specifically the invention relates to a ski boot, a ski binding and a boot and binding combination all of which are particularly useful for telemark skiing.

BACKGROUND OF THE INVENTION

Telemark skiing is very popular. In telemark skiing a skier wears ski boots which are attached to skis by ski bindings. The bindings do not hold the heels of the skier's boots fixed to the ski as do downhill ski bindings. Instead, telemark. ski bindings permit the skier to lift his or her heel away from the ski.

Telemark ski bindings are typically reinforced versions of cross-country ski bindings. In most such bindings the toe of a ski boot is connected to a ski by mating three holes on the underside of the toe to three corresponding pins on the binding. Such bindings are called "three-pin" bindings.

Telemark skiing requires a skier to carve an edge of the ski into the snow in order to maintain control. An ideal telemark ski binding system must provide good lateral stability. That is, while the binding system permits the skier's heel to move away from the ski, the binding system should not permit the skier's heel to move from side to side relative to the longitudinal centerline of the ski. While three-pin bindings, are generally effective they typically allow more lateral play between the boot heel and the ski than is desirable for top performance. This adversely impacts skier control. A telemark ski boot-binding system should also provide good torsional rigidity.

Another problem with some telemark ski binding systems is that the ski heel is able to move undesirable freely toward and away from the ski. This is a problem because a ski is a long object which therefore possesses a large moment of inertia about a transverse axis. Thus a skier can have difficulty in controlling the position of the heel portion of the boot relative to the ski as is essential for maintaining control and effecting good telemark turns.

In an effort to remedy the foregoing inadequacies of telemark binding systems binding manufacturers have added cables to their telemark bindings. Each binding has a toe piece portion which receives a toe portion of a skier's boot and a cable attached to the toe piece portion. The cable wraps around the heel of a skier's boot and is secured to the binding on both sides of the toe portion of the boot. The cable typically includes one or more extension springs. The springs maintain the cable under tension so that the cable pulls the boot heel forward toward the toe piece. This helps to ensure that the toe portion remains snugly secured within the clamp(s). In general, the cable has two main functions. First, it forces the toe of the boot firmly into the toe piece portion of the binding. This reduces lateral play between the boot and the ski. The forward force is greatest when the boot is in a "heel low" position, i.e., a substantially flat position on the ski.

Second, when the skier's boot is in a "heel high" position, i.e. the boot heel is lifted substantially away from the ski, the cable applies a force to the heel which has a component that tends to pull the heel back toward the ski. This helps a skier to maintain the heel and ski in a desired relationship during telemark turns.

Telemark cable binding systems have shortcomings. For example, it is typically impractical to make the cable tight enough to hold a ski boot firmly enough into a binding to eliminate lateral play. When the cable is made very tight it can exert enough force on the heel of the ski boot to overcome the stiffness of the toe of the boot and cause the toe portion of the boot to collapse onto the skier's foot. This very painful phenomenon is known commonly to skiers as "toe crunch" and can cause severe injury.

Another problem with cable bindings is that the position along the ski at which the cable pivots as the heel is raised is spaced apart from the position where the sole of the boot bends. This relationship of pivot points can result in "tip dive", which is a condition wherein the ski tip rotates precipitously downwardly into the snow. Tip dive generally unsettles the skier and is likely to cause the skier to fall.

The springs used in the cable bindings also tend to break prematurely during normal use. Replacing broken springs introduces undesirable costs. The cables, and their associated springs also tend to cut, mar and/or otherwise damage both the ski boot about which they are wrapped, and the boot attached to the adjacent ski. Such damage can occur as a result of the springs scraping back and forth against the outer surfaces of the boots.

Another disadvantage of some telemark bindings is that they do not release at all, or reliably, when a skier falls in a manner that places excessive forces on their legs.

Accordingly, there remains a need for alternatives to conventional cross-country and telemark boots and bindings in which the above-noted problems are ameliorated.

SUMMARY OF THE INVENTION

It is an object of this invention to provide an binding and boot assembly which is suitable for telemark skiing and which provides improved heel stability during use.

Accordingly, a first aspect of the invention provides a novel boot and binding assembly arranged for use with an elongate ski. The boot has a sole with a toe portion and a heel portion. An interconnect member underneath the sole of the boot is attached to the toe portion of the sole. The interconnect member has a rearward portion located between the toe and heel portions of the boot. The binding includes a toe piece, a latch assembly, raised portions and a release mechanism. During use, the toe portion mates with a toe piece on the elongate ski while one end of the interconnect member releasably mates with a latch assembly on the elongate ski. In this manner, since the pivotally-mounted interconnect member is secured to the elongate ski, the heel portion can be lifted away from the ski while the boot remains attached to the elongate ski. This enables a skier to execute cross country and telemark-style skiing manoeuvres as well as walk or hike.

In preferred embodiments the latch assembly comprises a pivoting clamp for securing a rearward end of the interconnect member and a spring mechanism for biasing the pivoting clamp into a latched configuration wherein the clamp holds the rearward end of the interconnect member.

Another aspect of the invention provides a ski boot comprising: a flexible sole having a toe portion and a heel portion, the toe portion for mating with a toe piece on a ski during use; and, an interconnect member for releasably mating with a latch assembly on the ski. The interconnect member is attached to the toe portion of the sole and has a rearward portion located between the toe and heel portions of the sole. A heel portion of the boot can be lifted away from a ski during use while the interconnect member remains releaseably attached to the ski. Preferably the sole comprises a sole stiffener for varying a flexing action of said boot. Most preferably the sole stiffener has a length about the same as a length of the interconnect member.

A further aspect of the invention provides a binding assembly for mounting a boot having a rigid interconnection member to an elongate ski, while permitting a heel of the boot to be lifted away from the ski by a skier. The binding assembly includes a toe piece for releasably securing a toe portion of a boot to the elongate ski during use; and a latch assembly mountable to the elongate ski behind the toe piece. The latch assembly releasably holds the interconnection member of a boot at a location under the boot and between a heel and toe of the boot. When the interconnection member is being held, a heel portion of the boot can be lifted away from the ski during use while maintaining releasable attachment of the boot with the ski.

A still further aspect of the invention provides a ski boot comprising: a resiliently flexible sole having a toe portion and a heel portion and a interconnect member for releasably mating with a latch assembly on the ski. The toe portion mates with a toe piece on a ski during use. The interconnect member is rigidly affixed to the toe portion of the sole and has a rearward portion located between the toe and heel portions of the sole. When the sole is flexed, the sole is lifted away from the interconnect member. In preferred embodiments the sole comprises a sole stiffener for varying a flexing action of said boot and the interconnect member is rigidly affixed to the sole stiffener.

A still further aspect of the invention provides a ski binding for mounting a boot having a rigid interconnection member to an elongate ski, while permitting a heel of the boot to be lifted away from the ski by a skier. The binding assembly comprises: a toe piece for releasably securing a toe portion of a boot to the elongate ski during use; and, a latch assembly mountable to the elongate ski behind the toe piece for releasably holding the interconnection member of a boot at a location under the boot and between a heel and toe of the boot. A heel portion of the boot can be lifted away from the ski during use while maintaining releasable attachment of the boot with the ski. The latch assembly comprises a pair of opposed forwardly biased members each capable of engaging a side edge of a rearward portion of an interconnection member and a member located to block upward movement of the rearward portion of an interconnection member.

These and other objects and features of the present invention will become more fully apparent from the following description and appended claims, or may be learned by the practice of the invention as set forth hereinafter.

BRIEF DESCRIPTION OF DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are not therefore to be considered to be limiting of its scope, the invention in its presently understood best mode for making and using the same will be described and explained with additional specificity and detail through the use of the accompanying drawings in which.

LIST OF REFERENCE NUMERALS

| | | | |
|---|---|---|---|
| 20 | boot and binding assembly | 22 | boot |
| 24 | toe portion | 26 | heel portion |
| 28 | lateral edges | 30 | toe piece |
| 31 | ski | 32 | raised portion (at heel) |
| 33 | raised portion (at toe) | 34 | sole of boot |
| 36 | interconnect member | 37 | channel |
| 42 | rear end of interconnect member | 44 | latch assembly |
| | | 48 | pivot axis |
| 46 | C-clamp | 52 | front portion of ski |
| 50 | block | 56 | aft portion of ski |
| 54 | spring mechanism | 60 | top of ski |
| 58 | end stop | 64 | hand grip |
| 62 | cord | 66 | upper surface of C-clamp |
| 65 | lip portion of toe piece | 72 | stiffener |
| 70 | notch | 76 | fasteners |
| 74 | rear end of raised portion | 80 | recess |
| 78 | tapered portion | 130 | toe piece |
| 120 | binding assembly | 132 | ridge |
| 131 | toe clamp | 136 | interconnect member |
| 134 | cam member | 138 | screw |
| 137 | block | 143 | side edges |
| 142 | rear end of interconnect member | 145 | bottom face |
| | | 147 | crosspiece |
| 144 | latch mechanism | 152 | rod |
| 146 | latch members | 154 | bar |
| 151 | spring wire | 222 | boot |
| 153 | ends of spring wire | 243 | front end of interconnect member |
| 156 | threaded shaft | | |
| 236 | interconnection member | 255 | socket |
| 250 | bevelled edges | 257 | aperture |
| 256 | overhanging edges | | |

DETAILED DESCRIPTION OF THE PREFERRED EMBODIMENTS

This invention relates to a novel boot and binding assembly preferably arranged for use with an elongate ski. The boot has a flexible sole with a toe portion and a heel portion. A rigid interconnect member is attached to and extends rearwardly from the sole. The binding includes a toe piece, a latch assembly, raised portions and a release mechanism.

During use, the toe portion of the boot is received in the toe piece, the rear edge of the rigid interconnect member is received in the latch and the flexible sole can bend to permit the heel portion of the boot to be lifted away from the ski.

As used herein, "ski" is any of a variety of telemark, cross-country or alpine skis, but is not so limited. As used herein, "boot" or "ski boot" is any of a variety of telemark, cross-country or alpine ski boots. The boots may be made of any suitable materials as are known to those skilled in the boot making arts.

Figure 1:
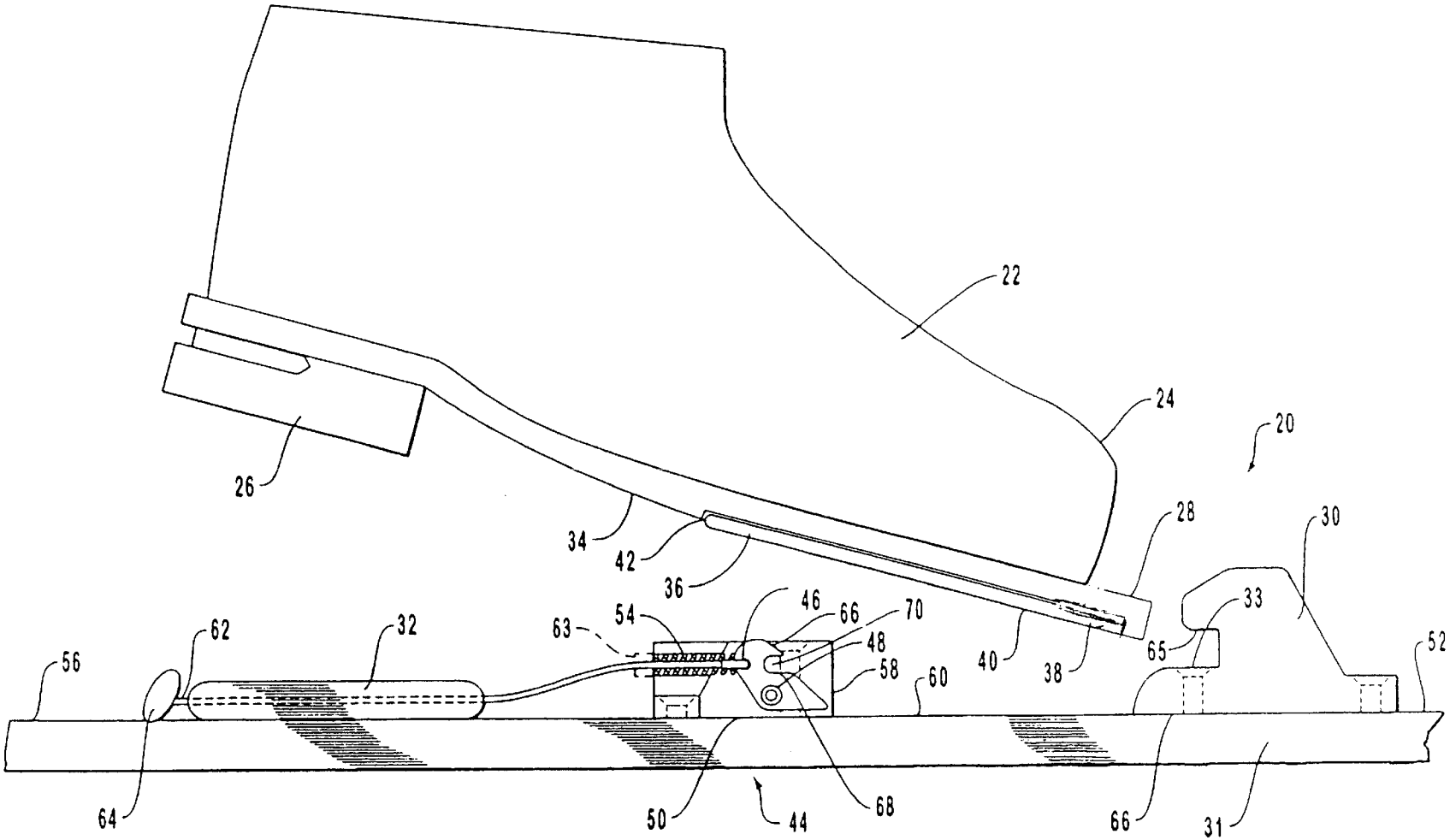
FIG. 1 is a side view of a boot and binding assembly according to this invention with the boot being readied for use.

FIG. 1, shows a boot and binding assembly 20 according to this invention. Boot 22 has a toe portion 24, a heel portion 26 and a rigid interconnect member 36 attached to and extending rearwardly from the toe portion. Interconnect member 36 may comprise a rigid plate Toe portion 24 is generally near the front end of boot 22 and has lateral edges 28. Heel portion 26 is generally near the back end of boot 22.

Binding assembly 20 includes a toe piece 30, and a latch assembly 44, both of which are affixed to a ski 31. Preferably latch assembly 44 is located under the sole 34 of boot 22. Most preferably the latch assembly is located in a region generally beneath the mid-portion of boot 22 which receives the ball of a skier's foot. The mid-portion is roughly mid-way between toe portion 24 and heel portion 26.

Preferably toe piece 30 includes a raised portion 33 which supports the underside of toe portion 28 and a raised portion 32 which supports the heel of boot 22. This allows boot 22 to rest substantially flat and generally parallel to the top surface of ski 31 during use even though latch 44 is under sole 34.

Interconnect member 36 has a first end 40 connected to toe portion 24. In use, a skier engages toe portion 24 in toe piece 30 and engages a rear end 42 of interconnect member 36 in latch 44. As interconnect member 36 is stiff, boot 22 cannot slide significantly forwardly or rearwardly relative to ski 31. As interconnect member 36 is rigidly attached to boot 22 and rear end 42 of interconnect member 36 is prevented from moving transversely by latch 44, assembly 20 can provide good lateral stiffness.

Figure 2:
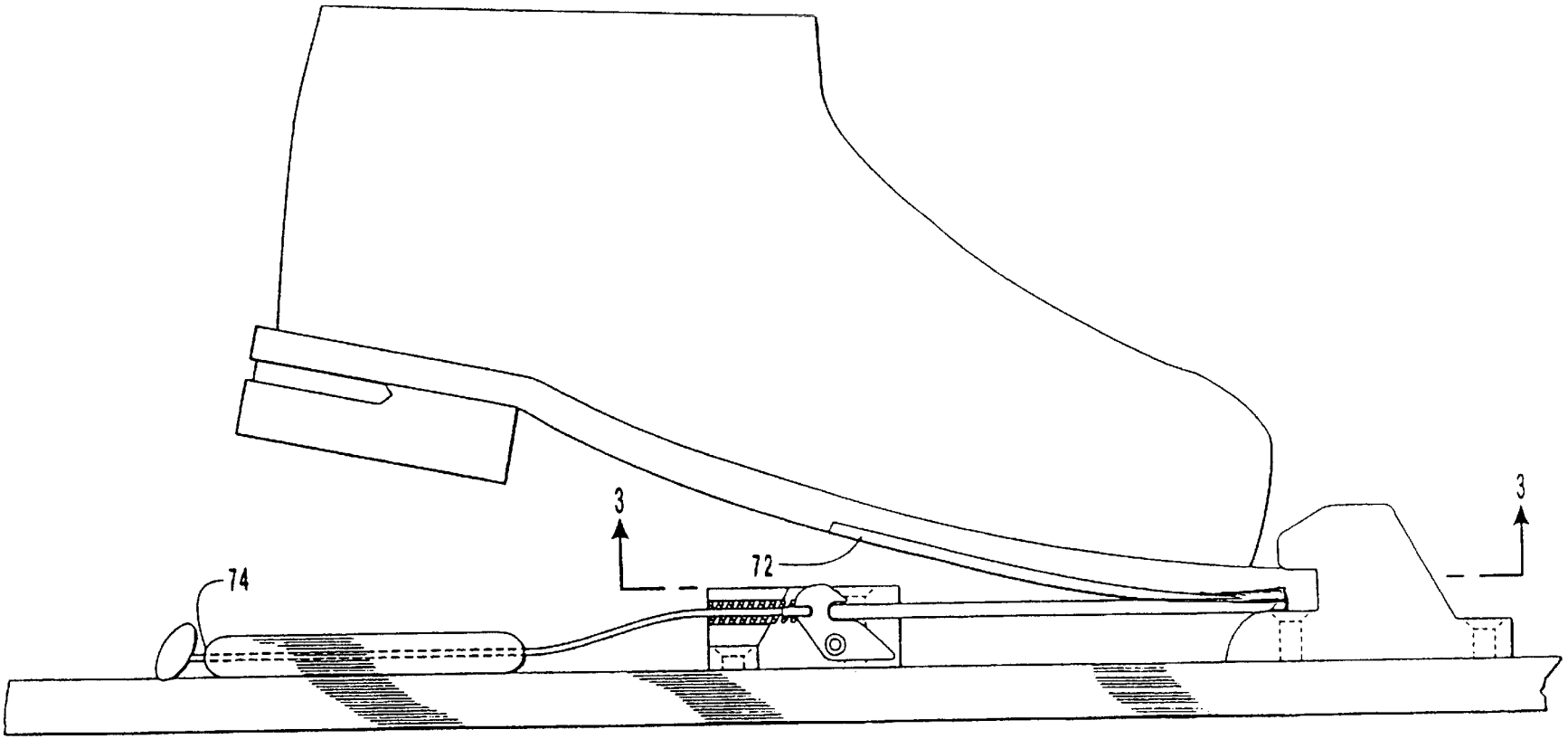
FIG. 2 is a side view of the boot and binding assembly of FIG. 1 with the boot in a heel high position during use.

The flex characteristics of sole 34 may be varied. Preferably sole 34 is resiliently flexible so that it tends to return boot 22 to a "heel down" position unless a skier is deliberately lifting his or her heel away from ski 31. To increase stability and extend longevity of boot 22, sole 34 is preferably reinforced with a sole stiffener 72 as shown in FIG. 2. Sole stiffener 72 can be of various cross-sections and sizes depending upon the desired stiffness of sole 34. Sole stiffener 72 may have various shapes and sizes. Sole stiffener 72 may be interior or exterior to boot 22 and may be joined at various positions to interconnect member 36.

Interconnect member 36 interconnects boot 22 and ski 31. As the forces imposed upon interconnect member 36 during skiing can be substantial, interconnect member 36 is constructed of a suitable material capable of withstanding such forces. Preferred materials include, but are not limited to, metals, plastics, combinations of metals and plastics and other similarly related materials.

Sole 34 is flexible. When sole 34 is not flexed, interconnect member 36 lies generally parallel to sole 34, as shown in FIG. 1. When sole 34 is flexed, as shown in FIG. 2, sole 34 pulls away from rear end 42 of interconnect member 36. In a preferred embodiment, when sole 34 is not being flexed, interconnect member 36 is received in a channel 37 in sole 34. This prevents interconnect member 36 from interfering unduly with walking while wearing boots 22. Interconnect member 36 is preferably reasonably short. Interconnect member 36 should preferably be less than about 6 inches long.

Interconnect member 36 is affixed to sole 34 in a manner which can withstand the maximum forces which could be expected during skiing. Preferably interconnect member 36 is affixed to boot 22, for example by rivets, welds, or the like, to a flexible stiffening plate 72 in sole 34. It is not necessary for interconnect member 36 to attach to a stiffening plate 72. Interconnect member 36 could be attached at the toe end of sole 34 in other suitable strong ways. For example, interconnect member 36 could be affixed by way of screws, rivets, or the like to a mounting plate (not shown) on the top side of sole 34 so that sole 34 is clamped between the mounting plate and interconnect member 36.

Figure 4:
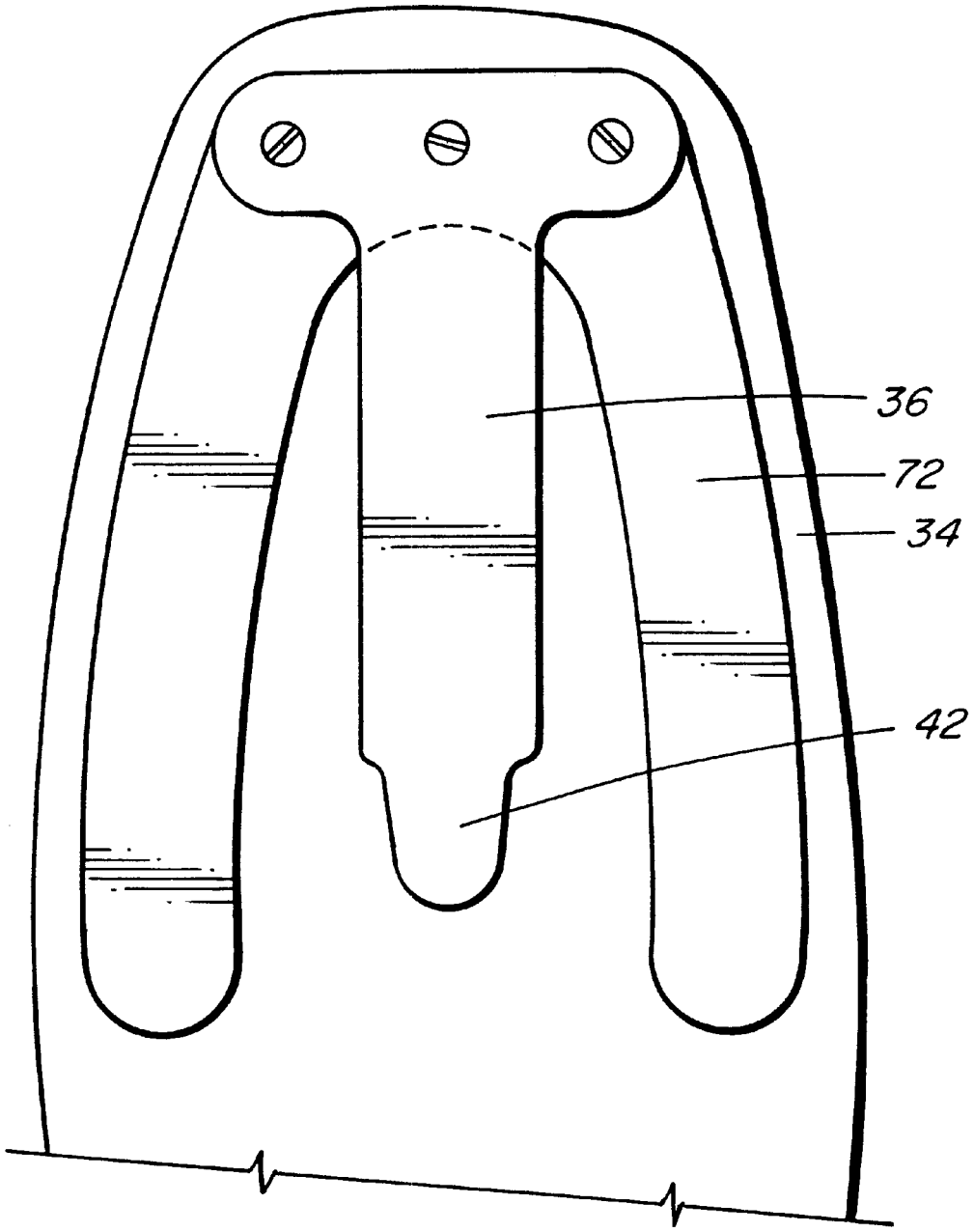
FIG. 4 is a bottom view of a ski boot according to the invention.

FIG. 4 shows a boot 22 equipped with a sole stiffener 72 according to a currently preferred embodiment of the invention. Sole stiffener 72 comprises a U-shaped sheet of spring steel integrated with sole 34. Stiffener 72 may be attached to sole 34 with fasteners, such as screws or rivets or may be molded into sole 34.

Latch assembly 44 may take various forms. In the embodiment shown in the drawings, latch assembly 44 comprises a generally "C" shaped clamp (hereinafter C-clamp) 46 pivotally mounted to a block 50. C-clamp 46 can pivot about a pivot point 48. Block 50 is attached to ski 31. Pivoting of C-clamp 50 about point 48 may be facilitated by any of a variety of hinge mechanisms.

C-clamp 46 is biased into a "latched" position wherein end 42 of interconnect member 36 is coupled to latch assembly 44. In the L illustrated embodiment, C-clamp 46 is biased toward a front end 52 of ski 31 by a spring mechanism 54 which is positioned within block 50. Spring mechanism 54 optimally biases C-clamp 46 forward with a bias force of about 10 pounds force. In the illustrated embodiment, spring mechanism 54 comprises an extension spring located on a side of the C-clamp 46 toward an aft portion 56 of ski 31. Preferably a mechanical end stop 58 limits forward motion of C-clamp 46. In the illustrated embodiment, end stop 58 comprises a member which limits forward motion of C-clamp 46 by abuttingly engaging a top 60 of ski 31. In this embodiment, end stop 58 comprises a projection which is formed integrally with C-clamp 46.

Figure 3:
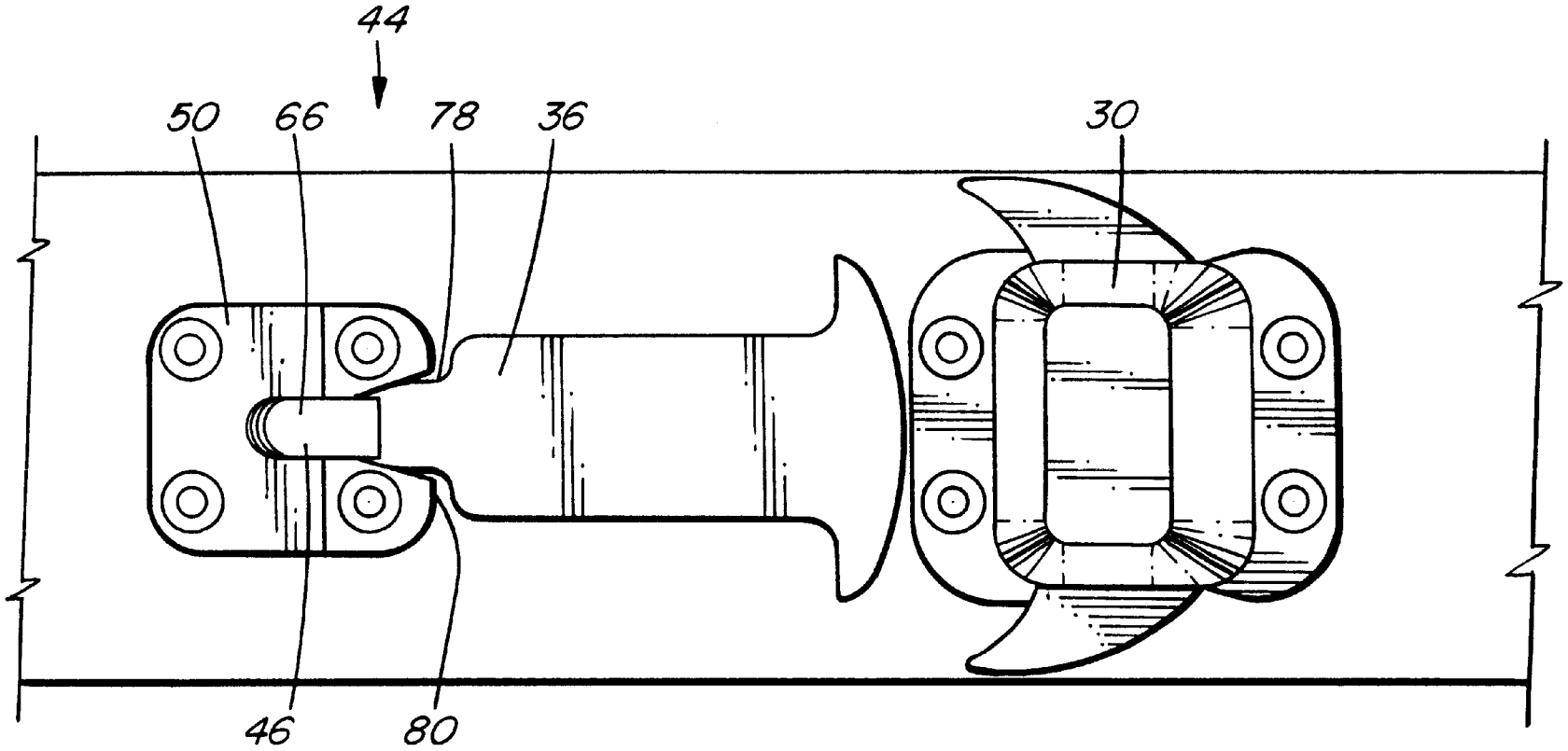
FIG. 3 is a cross section view of a preferred embodiment of a latch assembly mated with a interconnect member coupling the toe portion of the boot to the latch taken along the line 3—3 of FIG. 2.

FIG. 3 shows a preferred embodiment for latch assembly 44. Block 50 is secured to ski 31 at several points by suitable mechanical fasteners 76 as is well known in the art. Interconnect member 36 has a tapered portion 78 at its second end 42. Tapered portion 78 is shaped to fit securely into a correspondingly shaped recessed portion 80 of block 50. In this manner, the interconnect member 36 is prevented from substantial lateral movement when it is latched within block 50 and, thus, boot 22 is prevented from substantial lateral movement. This prevents the adverse effects of heel slippage during use. C-clamp 46 is arranged so that when it is in its "latched" position it prevents rear end 42 of interconnect member 36 from being lifted out of recessed portion 80 of block 50. C-clamp 46 has a sloped upper surface 66 to allow the user to step down onto the clamp. The force of the stepping down pivots C-clamp 46 away from the rearward end of interconnect member 36 and, when interconnect member 36 reaches the desired mating position, C-clamp 46 springs back to a latched position about the interconnect member.

A cord 62 having a handle 64 extends rearwardly from C-clamp 46. C-clamp 46 may be pivoted rearwardly into an "unlatched" position by pulling on cord 62. In the illustrated embodiment, cord 62 passes through a raised platform 32, which provides support for the heel portion of boot 22. Handle 64 is located in a position which is accessible to a skier. In a preferred embodiment, handle 64 abuts closely against a rear end 74 of the aft raised portion 32. This prevents cord 62 and handle 64 from interfering with skiing.

Toe piece 30 preferably provides a socket which receives toe portion 24 and permits toe portion 24 to be withdrawn rearwardly. When toe portion 24 is engaged in toe piece 30 toe piece 30 should prevent toe portion 24 from moving transversely relative to ski 31. Toe portion 24 and toe piece 30 may, for example, mate in a manner similar to the mating of a toe portion of an alpine ski boot and the toe piece of an alpine ski binding, both of which are well known in the art.

To use binding assembly 20 a skier places the toe portion 24 of boot 22 into toe piece 30 with rear end 42 of interconnect member 36 positioned over recessed portion 80 of block 50. The skier mates toe portion 24 with the toe piece 30 by inserting lateral edges 28 underneath a protruding lip portion 65 of toe piece 30.

Once toe portion 24 is in toe piece 30, the skier steps downward until second end 42 of interconnect member 36 strikes an upper surface 66 of C-clamp 46. Surface 66 is angled so that the downward pressure exerted by interconnect member 36 causes C-clamp 46 to pivot toward its unlatched position against the bias force exerted by spring mechanism 54. C-clamp 46 continues to pivot rearwardly until the rear end 42 of interconnect member 36 can drop into recessed portion 80. Spring mechanism 54 then pushes C-clamp 46 forward so that rear end 42 of interconnect member 36 is captured in a notch 70 in C-clamp 46. Thereafter, the force exerted by spring mechanism 54 holds C-clamp 46 in its forward latched position (i.e. clockwise about pivot point 48 as seen in FIG. 2).

In this manner, interconnect member 36 is secured between latch mechanism 44 and toe piece 30 as shown in FIG. 2. Since interconnect member 36 is affixed to boot 22, boot 22 is secured to ski 31 and is ready for skiing use. Such use may include, but is not limited to, telemark, cross-country skiing and alpine touring. During use, sole 34 of boot 22 can be flexed away from ski 31 so that heel portion 26 of boot 22 can be lifted to permit telemark turns and hiking-style skiing.

After use, boot 22 can be released from the ski 31 by pulling handle 64. This retracts C-clamp 46 to its unlatched position (in the illustrated embodiment this rotates C-clamp 46 counter-clockwise about pivot 48 as viewed in FIG. 2). When C-clamp 46 is in its unlatched position then the user lifts the heel portion 26 upward. This lifts interconnect member 36 out of recessed portion 80. The user then pulls boot 22 backwards and away from the toe piece 30 to free boot 22 from binding assembly 20.

Preferably binding 20 releases before it transmits excessive forces, especially excessive twisting forces, to a skiers leg. One way to provide such a release is to use a release type of toe piece 30. For example, toe piece 30 may comprise the toe piece of an alpine type ski binding suitably adapted to receive toe portion 24 of boot 22. Another way to provide such a release is to make latch 44 release end 42 of interconnect member 36 whenever the laterally directed force on interconnect member 36 exceeds a predetermined threshold. Preferably both toe piece 30 and latch 44 are designed to release when they are subjected to large forces directed transverse to ski 31.

Figure 5:
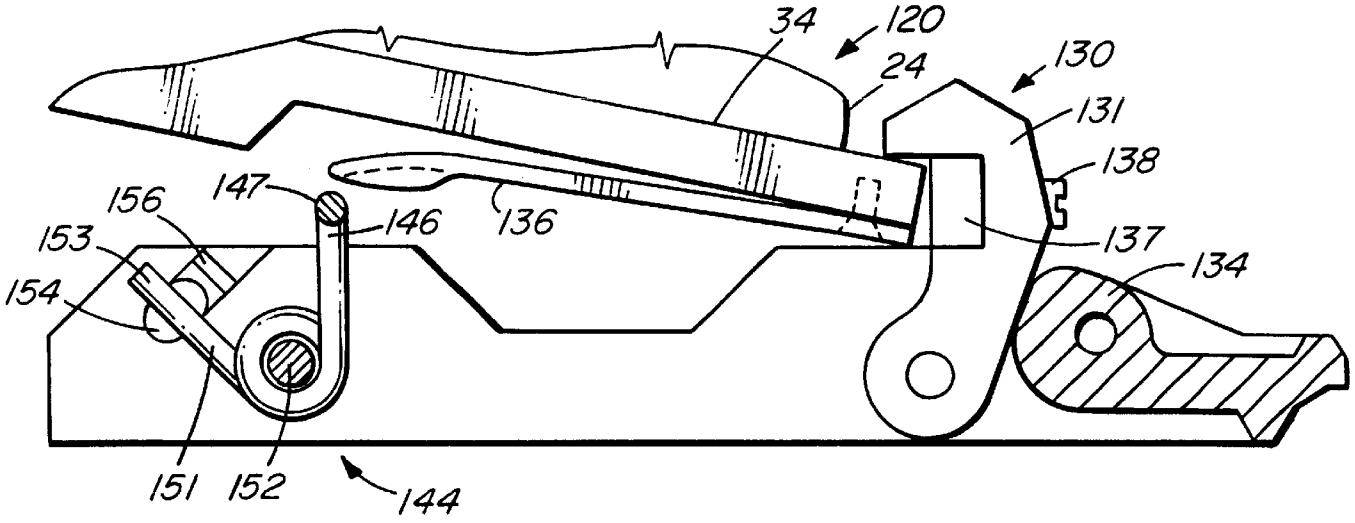
FIG. 5 is a section through a binding assembly according to an alternative embodiment of the invention.
Figure 6:
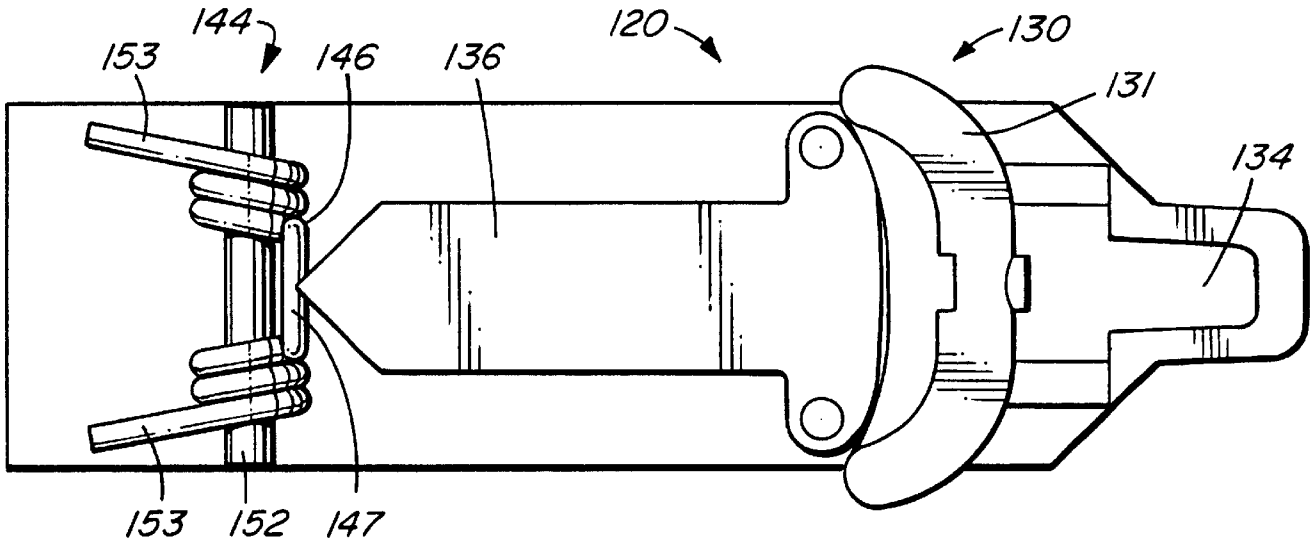
FIG. 6 is a top plan view of the binding assembly of FIG. 5.

FIGS. 5 and 6 show partially schematic views of a binding assembly 120 according to an alternative embodiment of the invention. Binding assembly 120 has a latch mechanism 144 and a toe piece 130. A boot 22 has a rearwardly extending rigid interconnect member 136 attached at its toe end. A rear end 142 of interconnect member 136 has angled side edges 143.

In use, toe portion 24 of boot 22 is received in toe piece 130 in substantially the same manner as a toe portion is received in the toe piece 30 which is described above. Rear end 142 of interconnect member 136 is received between a pair of forwardly biased members 146 with each side edge 143 in contact with one of members 146. In the embodiment of FIGS. 5 and 6, interconnect member 136 has an angled bottom face 145 and members 146 are connected by a crosspiece 147. This permits a skier to insert toe portion 24 into toe piece 130 and then step downwardly to force angled bottom face 145 against crosspiece 147. This forces crosspiece 147 rearwardly until it clears the end 142 of interconnect member 136. When crosspiece 147 clears interconnect member 136, interconnect member 136 drops below crosspiece 147 and members 146 snap forwardly to capture end 142 of interconnect member 136 below crosspiece 147. Crosspiece 147 is located to block upward movement of the rear end of interconnect member 136. In this latched configuration members 146 press forwardly on side edges 143.

If a skier twists his or her leg relative to ski 31 one side edge 143 of interconnect member 136 applies a transversely directed force to one of members 146. This tends to drive the member 146 rearwardly. If the transverse force is sufficiently large then member 146 is driven rearwardly past the end of interconnect member 136 and boot 22 is released from binding assembly 120.

In the embodiment of FIGS. 5 and 6, members 146 and crosspiece 147 comprise three sides of a loop of stiff spring wire 151. spring wire 151 wraps around a rod 152 and has projecting ends 153. A bar 154 mounted on a threaded shaft 156 bears against ends 153. The amount of preload on spring 151, and, consequently, the force required to release boot 22 can be adjusted by turning threaded shaft 156 to adjust the position of bar 154.

Binding assembly 120 comprises a toe piece 130. Toe piece 130 comprises a pivotally mounted toe clamp 131 which has an overhanging ridge 132. A toe portion 24 of a ski boot 22 can be received under ridge 132. Toe clamp 131 is pivotally displaceable between a rearward, engaged position, which is illustrated in FIG. 5, and a forward, disengaged, position. A cam member 134 can be pivoted forwardly, as shown in FIG. 5, to lock toe clamp 131 in its engaged position. Cam member 134 can be lifted to allow toe clamp 131 to pivot forwardly into its disengaged position.

A skier can step into binding assembly 120 by engaging toe portion 24 of a ski boot 22 with toe clamp 131 and stepping downward so that the rearward end of interconnection member 136 is received under spring 151 as described above. When the skier wishes to release binding 120 the skier can lift cam member 134. This allows the skier to slide boot 22 and toe clamp 131 far enough forward that the rear end of interconnection member 136 is no longer retained in latch member 144. A block 137 in toe clamp 131 can be moved forward or rearward with a crew 138 to adjust binding 120 to fit a given boot.

Latch assembly 144 may optionally be mounted on rails (not shown) so that its position can be adjusted to suit the length of the interconnect member of a particular ski boot 22.

The foregoing embodiments provide several advantages over the prior art. For example, when a skier lifts his or her heel upward during use, there is no cable to impose excessive forces on the skier's leg and boot. "Toe crunch" and premature exhaustion of the skier are avoided. There is no cable which could damage the outside of a ski boot. There are no cable springs to replace. Sole 34 can be designed to optimize its flex characteristics without the requirement that it be able to withstand large forces exerted by a cable.

It should also be appreciated that the foregoing invention may be represented in still other forms. For example, the binding may be arranged so that interconnect member 36 can be received in the binding before securing toe portion 28 with toe piece 30. This alternative arrangement equates to securing the boot in a heel-then-toe sequence rather than a toe-then-heel sequence as described above.

In embodiments like those of FIGS. 5 and 6 which have a toe piece 130 which can be released, releasing latch mechanism 144 could be replaced with a non-releasing latch mechanism. Such a binding would receive a rigid interconnection member 36 as described above.

Figure 7A:
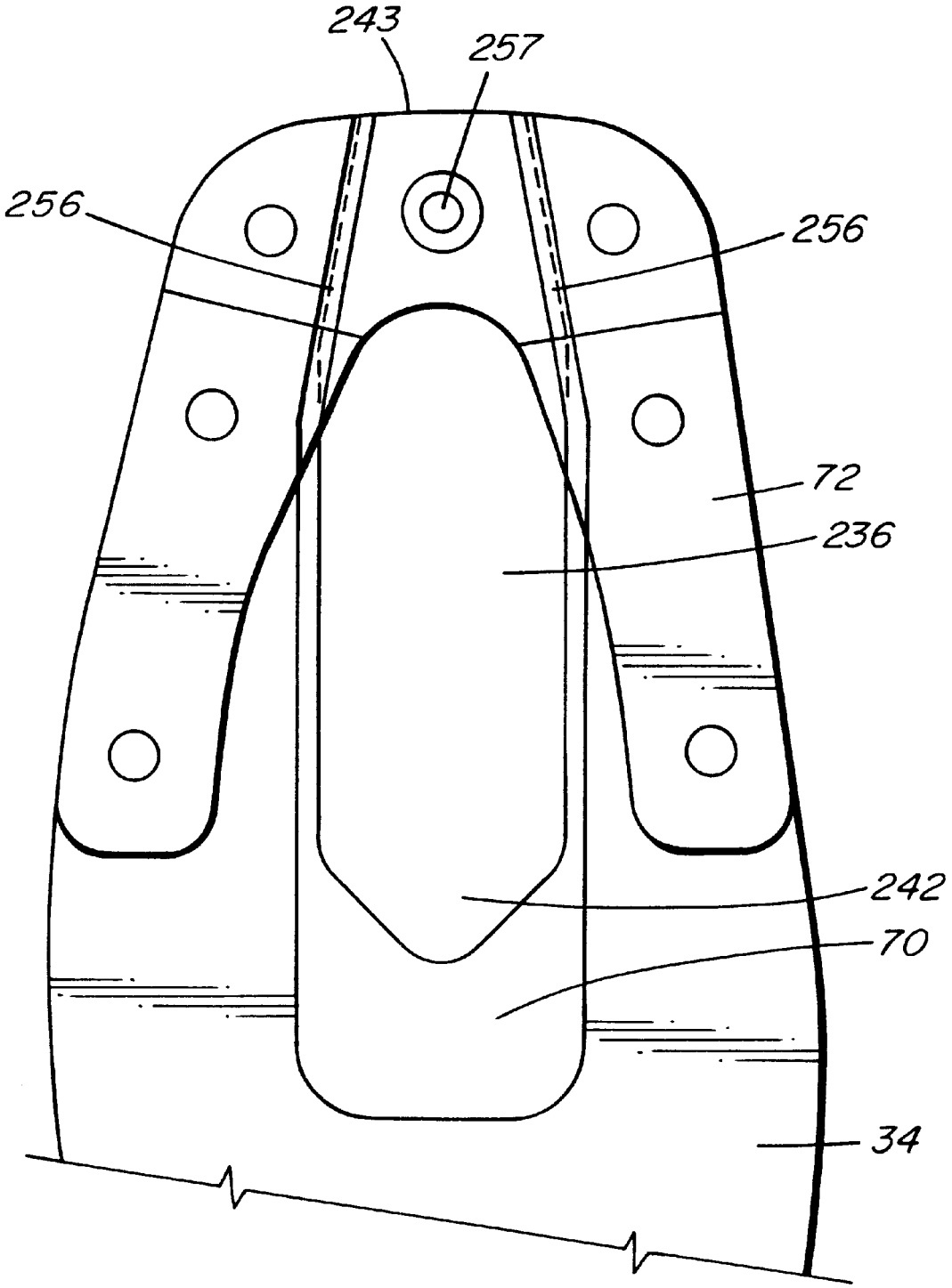
FIG. 7A is a bottom plan view of a boot equipped with a removable interconnection member according to an alternative embodiment of the invention; and, FIG. 7B is a transverse elevational section through the boot of FIG. 7A.
Figure 7B:
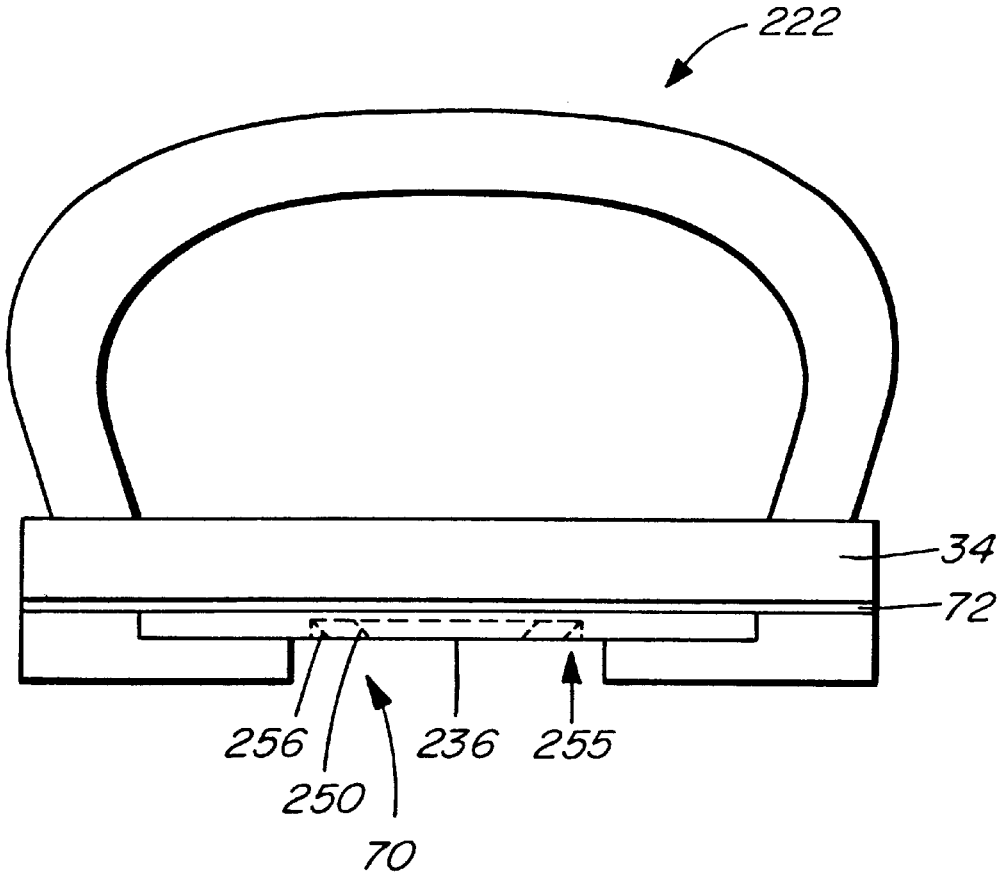

Interconnect member 36 may be non-removably affixed to boot 22 or may be removably affixed by means of removable screws or other suitable fasteners. For example, FIGS. 7A and 7B show a boot 222 having a detachable interconnection member 236. A front end 243 of interconnect member 236 is tapered in width and has bevelled edges 250. A socket 255 receives front end 243. Socket 255 is tapered in width and has overhanging edges 256 which bear against edges 250 when front end 243 is received in socket 255. In this embodiment, socket 255 has a dovetail shape in cross section. A screw or other suitable removable fastener (not shown) can be inserted through an aperture 257 in interconnect member 236 into sole 34 of boot 222 to releasably lock interconnect member 236 in socket 255. Instead of a fastener which is not attached to boot 222, the fastener may comprise a spring loaded pin or leaf which projects from sole 34 into aperture 257.

In use, the rear end of interconnect member 236 and the toe of boot 222 are compressed together between a latch mechanism and a toe piece. This tends to keep interconnect member 236 firmly seated in socket 255 during use. A user may chose to remove interconnect member 236 to make it easier to walk in boot 222. The user can also readily replace an interconnect member 236 which becomes worn. In either case, interconnect member 256 can be released, for example, by removing a fastener from aperture 257 and then pulled rearwardly until it comes out of socket 255.

Boot 22 may be variously strengthened depending upon how "stiff" of a flexing action the skier desires. Such stiffness can be, respectively, increased or decreased by increasing or decreasing the cross sectional thickness of sole stiffener 72.

The C-clamp 46 can be further away from or closer to toe piece 30 depending upon the desired pivoting action of the ski boot. Such alternatives may also be dictated by manufacturing concerns such as material costs and tolerances. C-clamp 46 need not pivot. All that is necessary is a mechanism for retaining the rear end 42 of interconnect member 36. For example, the pivoting C-clamp 46 could be replaced with members which slide longitudinally or transversely into a configuration wherein the rear end 42 of interconnect member 36 is retained in latch 44. If a movable toe piece, such as toe piece 130 of FIGS. 5 and 6 is used then latch 44 could be replaced with a socket which receives and holds the rear end of interconnect member 36. A user can engage interconnect member 36 in the socket and then clamp interconnect member 36 in place by moving the toe piece rearwardly.

The latch assembly 44 may also be configured with various alternative latches that correspond to variations in interconnect member 36. Such alternatives include, but are not limited to, "snap-in" configurations, locking ball and socket combinations, snap-locking ring arrangements and any other latching mechanisms that releasably mate with the interconnect member while allowing the heel of the boot to be lifted away from ski 31.

In the latch assembly 44 illustrated in FIGS. 1–3 the construction of the end stop may be varied. End stop 58 may comprise any suitable construction which limits the pivot motion of C-clamp 46. Such constructions are well known to engineers engaged in ski design and not described herein in detail. As one example of such an alternative construction a cable stop 63 (drawn in phantom) on cord 62 bears against a rear face of block 50 and thereby limits the forward position of C-clamp 46. The cable stop 63 may take various forms as is obvious to those skilled in the art in light of the foregoing description.

Alternative release mechanisms may be provided in addition to, or instead of cord 62.

The toe piece may also be configured as a clamp biased to latch onto the first end of the interconnect member in a manner similar to that of the second end. Other alternative toe pieces, include, but are not limited to, sideways snap-in toe locks, clasps, hasps, bolts, latches and other similar mechanisms for releasably securing the toe portion to the ski.

Either or both latch 44 and toe piece 30 may release automatically if a force exceeding a threshold is applied.

This invention may be embodied in still other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A boot and binding assembly for an elongate ski, the assembly comprising:

a boot having a sole, the sole being elongated and adapted to flex along its length and having a toe portion, a heel portion and an elongated interconnect member fixedly attached to said toe portion, said interconnect member extending rearwardly from said toe portion and having a rearmost portion located between the toe and heel portions of the boot;

a binding having a toe piece mountable to said ski for receiving the toe portion of the boot; and, a latch assembly mountable to said ski behind the toe piece and under the sole of the boot for releasably holding said rearmost portion of said interconnect member;

wherein, when the toe portion is received in the toe piece and the rearward portion of the interconnect member is held by the latch assembly, the interconnect member is secured to the ski in a position extending substantially parallel to an upper surface of the ski and the heel portion of the boot can be lifted away from the ski and at least a portion of said sole can be lifted away from at least said rearmost portion of said interconnect member by flexing said sole while the ski boot remains releasably mated to the ski by means of said interconnect member.

2. The boot and binding assembly of claim 1 wherein said latch assembly comprises a pivoting clamp for securing said rearmost portion of the interconnect member.

3. The boot and binding assembly of claim 2, comprising a spring mechanism for biasing the pivoting clamp into a latched configuration wherein the clamp holds the rearmost portion of the interconnect member.

4. The boot and binding assembly of claim 3, comprising a cord coupled to the pivoting clamp, the cord having a portion extending behind the heel portion of the boot, wherein the pivoting clamp can be moved to an unlatched configuration by pulling the cord.

5. The boot and binding assembly of claim 1 wherein the boot comprises a sole stiffener for varying the degree of said flexing.

6. The boot and binding assembly of claim 5 wherein the sole stiffener is attached to the interconnect member at the toe portion of the boot.

7. The boot and binding assembly of claim 1 wherein the boot comprises lateral edges for facilitating securement of the toe portion by the toe piece.

8. A ski boot comprising:

a longitudinally flexible sole having a toe portion and a heel portion, the toe portion for mating with a toe piece on a ski during use; and, an interconnect member for releasably mating with a latch assembly on the ski, the latch assembly being mounted to the ski behind the toe piece, the interconnect member being fixedly attached to the toe portion of the sole and having a rearmost portion located below the sole and: between the toe and heel portions of the sole, the interconnect member being releasably secured to the ski in a position extending substantially parallel to an upper surface of the ski with the rearmost portion of the interconnect member being held by said latch assembly;

wherein the heel portion of the boot can be lifted away from the ski and at least a portion of said sole can be lifted away from at least the rearmost portion of said interconnect member during use by flexing said sole while said interconnect member remains releasably attached to said ski by means of said latch assembly and said toe piece.

9. The boot of claim 8 wherein the sole comprises a sole stiffener for varying the degree of said flexing.

10. The boot of claim 9 wherein the sole stiffener has a length about the same as a length of the interconnect member.

11. A binding assembly for mounting a boot to an elongate ski, the boot having an elongated sole which is adapted to flex along its length and having a toe portion, a heel portion and an elongated interconnect member fixedly attached to the toe portion, the interconnect member extending rearwardly from the toe portion and having a rearmost portion located between the toe and heel portions of the boot, the binding assembly comprising:

a toe piece mountable to said ski for receiving the toe portion of the boot; and, a latch assembly mountable to said ski behind the toe piece and under the sole of the boot for releasably holding said rearmost portion of said interconnect member;

wherein, when the toe portion is received in the toe piece and the rearward portion of the interconnect member is held by the latch assembly, the interconnect member is secured to the ski in a position extending substantially parallel to an upper surface of the ski and the heel portion of the boot can be lifted away from the ski and at least a portion of said sole can be lifted away from at least the rearmost portion of said interconnect member by flexing said sole while the ski boot remains releasably mated to the ski by means of said interconnect member.

12. The binding assembly of claim 11 wherein the latch assembly is capable of pushing the interconnect member forward so as to hold at least a part of the toe portion of the ski boot underneath a part of the toe piece during use.

13. The binding assembly of claim 11 wherein the latch assembly comprises a pivoting clamp having a notch capable of receiving said rearmost portion of the interconnect member.

14. The binding assembly of claim 11 comprising front and rear raised portions respectively for supporting a toe portion and a heel portion of a boot above the ski with the interconnect member aligned with the latch assembly.

* * * * *